US012241328B1

(12) United States Patent
Hashmi

(10) Patent No.: US 12,241,328 B1
(45) Date of Patent: Mar. 4, 2025

(54) AUTOCENTRIC SELF-ALIGNING TUBING HANGER DEPLOYMENT TOOL

(71) Applicant: SAUDI ARABIAN OIL COMPANY, Dhahran (SA)

(72) Inventor: Ahmad Atef Hashmi, Abqaiq (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/457,753

(22) Filed: Aug. 29, 2023

(51) Int. Cl.
*E21B 3/04* (2006.01)

(52) U.S. Cl.
CPC ..... *E21B 3/04* (2013.01)

(58) Field of Classification Search
CPC ..... E21B 3/04
See application file for complete search history.

(56) References Cited

U.S. PATENT DOCUMENTS 1,787,476 A * 1/1931 Gattrell ..... E21B 19/08 464/166
2,215,047 A * 9/1940 Marshall, Jr. ..... E21B 3/04 73/152.44
2,435,985 A * 2/1948 Stewart ..... G01N 27/83 324/234
2,564,119 A * 8/1951 Mathews, Jr. ..... E21B 3/04 173/166
2,987,822 A * 6/1961 Arps ..... E21B 47/04 33/736
3,874,196 A * 4/1975 Hisey ..... E21B 3/04 175/195
7,028,787 B2 * 4/2006 Allen ..... E21B 21/01 464/166
8,316,929 B2 11/2012 Angelle et al.
2003/0221871 A1 * 12/2003 Hamilton ..... E21B 19/14 175/85
2012/0097454 A1 * 4/2012 Kockeis ..... E21B 19/15 175/57
2016/0186510 A1 * 6/2016 Vestersjo ..... E21B 19/00 166/380
2018/0238127 A1 * 8/2018 Berry ..... E21B 19/24
2019/0106950 A1 * 4/2019 Alvaer ..... E21B 19/16

* cited by examiner

*Primary Examiner* — Shane Bomar
(74) *Attorney, Agent, or Firm* — Vorys, Sater, Seymour and Pease LLP

(57) ABSTRACT

A well system includes a platform providing a deck, a rotary table mounted to the deck and defining a central opening through which tubulars are extendable from the platform and into a wellbore, and a tubular deployment tool mounted to the rotary table and operable to center the tubulars within the central opening. The tubular deployment tool includes a guide support mounted to the rotary table, one or more actuatable arms pivotably coupled to the guide support, and one or more guides rotatably mounted to each actuatable arm to apply a radial load against the tubulars extended through the central opening.

20 Claims, 4 Drawing Sheets

AUTOCENTRIC SELF-ALIGNING TUBING HANGER DEPLOYMENT TOOL

FIELD OF THE DISCLOSURE

The present disclosure relates generally to the setting of hangers in oil and gas wellheads, and, more particularly, to an apparatus operable to center landing joint strings when running and setting tubing hangers.

BACKGROUND OF THE DISCLOSURE

Oil and gas wells are drilled into the subterranean environment to provide access to producible hydrocarbons. In order to reach deeper and deeper depths over changing pressure regimes, numerous extensions of casings and liners are often positioned in the subterranean and extended back to surface where they are secured within a wellhead arranged at the surface. Once total depth is reached, the final extension of tubulars often consists of a long string of smaller diameter tubing through which hydrocarbons will ultimately be produced. This smaller diameter tubing also extends back to surface to be secured within the upper-most component of the wellhead, sometimes referred to as the "tubing head spool".

Because the tubing is the final tubular run and necessary for hydrocarbon production, accurate setting and landing of the tubing hanger within the tubing head spool is crucial. Further, the tubing hanger and its seal system provide a barrier to potential uncontrolled releases of hydrocarbon to the Earth's surface. Accordingly, proper alignment of the landing joint string is essential to the successful positioning and setting of the tubing hanger.

Accordingly, an apparatus capable of self-aligning a landing joint string is desirable to assist in assuring the tubing hanger lands in the tubing head spool without damage to the equipment and without injury to rigsite personnel.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a well system may include a platform having a deck with a rotary table mounted to the deck and defining a central opening through which tubulars are extendable from the platform and into a wellbore. A tubular deployment tool may be mounted to the rotary table and operable to center the tubulars within the central opening. The tubular deployment tool may comprise a guide support mounted to the rotary table, one or more actuatable arms pivotably coupled to the guide support and one or more guides rotatably mounted to each actuatable arm to apply a radial load against the tubulars extended through the central opening.

According to another embodiment consistent with the present disclosure, a tubular deployment tool may comprise a guide support mountable to a rotary table forming part of a deck of an oil and gas platform, one or more actuatable arms pivotably coupled to the guide support and one more guides rotatably mounted to each actuatable arm and operable to apply a radial load against and center tubulars extended through the rotary table.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
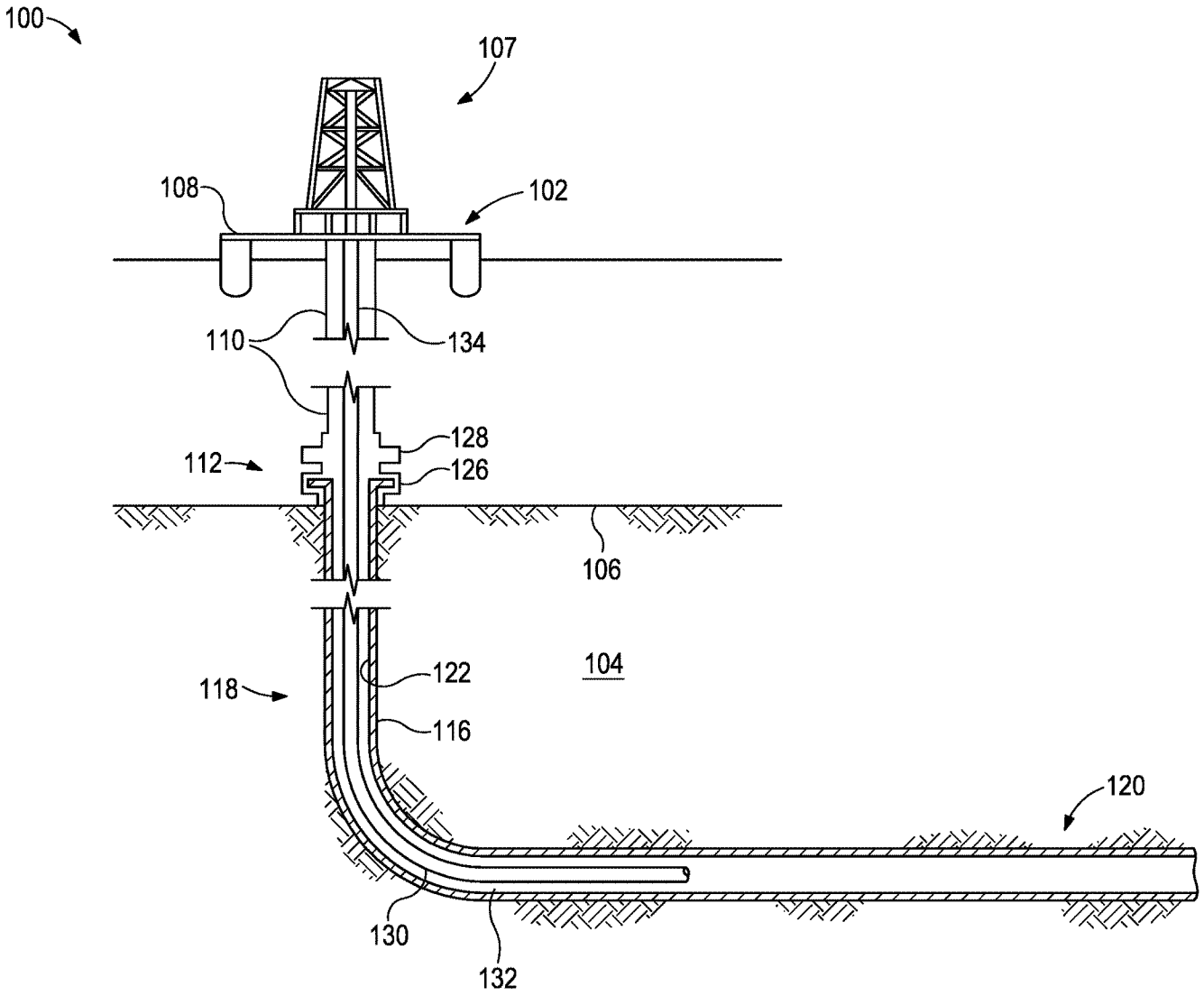
FIG. 1 is a schematic of an exemplary well system, according to one or more embodiments of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to the setting of tubing hangers in oil and gas wellheads, and, more particularly, to a system and apparatus operable to center a landing joint string when running and setting a tubing hanger in a tubing head spool. The present disclosure describes an apparatus operable during the final stages of well construction wherein the well has been drilled to its total depth, is lined with the applicable casings and/or liners and requires the installation of an extension of production tubing through which hydrocarbons may be produced. The production tubing must be secured at surface within the tubing head spool of the wellhead, and the apparatus and systems described may be beneficial in centering the landing joint string of the production tubing within the rotary table as the tubing hanger is lowered into the wellhead.

Although the embodiments disclosed herein specifically refer to the setting of a tubing hanger, those of ordinary skill will recognize the described apparatus and system may be adapted for use in other applicable operations including, but not limited to, the setting of casing and liner hangers. The apparatus and systems described herein include actuatable guides to self-center and guide the landing joint string through the rotary table, which helps mitigate risk of damage to equipment when running the tubing hanger and coupled landing joint string. Because the apparatus is self-adjusting and actuatable, its use further removes rigsite personnel from potential danger zones and thus lessens the risk of harm to operators when running the tubing hanger and landing joint string.

FIG. 1 is a schematic diagram of an example well system 100 that may employ one or more principles of the present disclosure, according to one or more embodiments. In the illustrated embodiment, the well system 100 includes an offshore oil and gas platform 102 centered over a submerged oil and gas formation 104 located below a seafloor 106. Even though FIG. 1 depicts the platform 102 being used in an offshore application, it will be appreciated by those skilled in the art that the various embodiments discussed herein are equally well suited for use in conjunction with other types of oil and gas platforms or rigs, such as land-based oil and gas rigs or rigs located at any other geographical site.

A derrick 107 is positioned on a deck 108 of the platform 102, and a subsea conduit 110 extends from the deck 108 to a wellhead 112 located at the seafloor 106. The derrick 107 is configured to house and support hoisting equipment (not shown) that is operable to hoist, lift and suspend components as necessary. A wellbore 116 extends from the wellhead 112 and into the subterranean environment through various earth strata, including the formation 104. The wellbore 116 has an initial, generally vertical portion 118 and a lower, generally deviated portion or horizontal portion 120. The wellbore 116 may be lined with one or more strings of casing 122 secured within the wellbore 116 using cement.

The deck 108, also referred to as the "rig floor", may include a rotary table (not shown) through which extensions of drill pipe, tubing, downhole tools, and the like, are extended (or "run") from the platform 102 and into the subterranean. For example, the casing 122 is run into the wellbore 116 through the rotary table included on the deck 108.

The wellhead 112 may include several discrete components, such as a casing head housing 126 and a production tubing head housing 128. The casing 122 extends from the casing head housing 126 and into the wellbore 114. The casing 122 may be secured within and in fluid communication with the casing head housing 126, which may include a generally cylindrical exterior body with an interior that defines a bowl sized to receive and suspend the casing 122. More specifically, the casing 122 is operatively coupled to a casing hanger configured to be received by the bowl and operable to both suspend the casing 122 and provide a sealed interface within the casing head housing 126.

Although not shown, the wellhead 112 may further include a second or "lowermost" casing head housing operatively coupled to a string of surface casing (not shown) extended into the wellbore 116. In such embodiments, the casing 122 may be concentrically arranged within the interior of the surface casing.

The production tubing head housing 128, as mentioned, is operatively coupled to and positioned atop the casing head housing 126. Like the casing head housing 126, the production tubing head housing 128 may include a generally cylindrical exterior body and an interior that defines a bowl configured to receive a string of production tubing 130. The bowl may define a shoulder operable to both suspend the production tubing 130 and provide a sealed interface, which may isolate a tubing-casing annulus 132 defined between the production tubing 130 and the casing 122. In other embodiments, the production tubing 130 may be secured and suspended via a tubing head adapter (not shown) that may be positioned directly atop the production tubing head housing 128 and below a production tree.

In FIG. 1, a landing joint string 134 is shown extending from the platform 102. The landing joint string 134 may comprise multiple extensions of thick-wall pipe or tubing designed to have a high load capacity and tensile strength sufficient to run lengths of casings 122, liners, production tubing 130 or similar. The landing joint string 134 is used to seat a tubing hanger (not shown) within the tubing head housing 128 of the wellhead 112. In such embodiments, a tubing hanger running tool (not shown) may be secured to the distal end of the landing joint string 134, and the tubing hanger running tool may then be operatively coupled to the tubing hanger. The tubing hanger is configured to be set within the tubing head housing 128 and operable to receive and suspend the production tubing 130, while simultaneously providing an annular seal within the tubing-casing annulus 132.

Generally, the tubing hanger also includes a sealing system comprising external seals that help further ensure isolation within the tubing-casing annulus 132. The proximal end of the production tubing 130 is operatively coupled to the base of the tubing hanger. Accordingly, as lengths of landing joint string 134 are coupled together (via matable threaded engagement) and extended toward the wellhead 112, the production tubing 130 is extended further into the wellbore 116 to a predetermined setting depth. And simultaneously, in a step not shown, the tubing hanger will be positioned (based upon calculations) so that it may be seated and secured within the interior bowl of the production tubing head housing 128.

In preparation to land out the tubing hanger, the landing joint string 134 is often lifted into the derrick 107 and lowered through the rotary table utilizing slings, a winch and/or air hoist (commonly referred to as an "air tugger"). As a result, the landing joint string 134 when coupled to the tubing hanger running tool may not be centralized within the rotary table as it is lowered through the rotary table and below the rig floor (i.e., the deck 108) toward the wellhead 112. Lack of centralization in the landing joint string may be problematic in properly aligning and setting the tubing hanger within the tubing head housing 128. Moreover, improper setting of the tubing hanger may damage the seals and otherwise render the seals ineffective as a necessary barrier to hydrocarbon flow within the tubing-casing annulus 132. Inaccurately setting the tubing hanger may also result in improperly scaling the tubing-casing annulus 132, thereby negating a critical barrier to potential hydrocarbon flow.

In some instances, the platform 102 may not be directly positioned above the wellhead 112, or more particularly, the platform 102 may not be aligned so that the rotary table is centered directly above the wellhead 112. When setting the tubing hanger, the production tubing 130 is already extended through the wellhead 112, however, the tubing hanger may still be offset from the center of the wellhead 112. Consequently, rigsite personnel may have to manually adjust (orient) the landing joint string 134 at the platform 102 to change the alignment or reposition when the tubing hanger is positioned at or near the wellhead 112. Such adjustments and operations require rigsite personnel to be located in potential zones of danger where the risk of dropped objects is high and generally, risk to personal safety is higher. Manually aligning the landing joint string 134 so that the tubing hanger may properly land in the tubing head housing 128 can be time consuming, thus resulting in additional cost. In other instances, the misalignment of the platform 102 to the wellhead 112 results in improper setting of the tubing hanger or multiple setting attempts that could potentially damage the tubing hanger seals, which could result in the loss of a barrier to flow within the tubing-casing annulus 132, as discussed above.

According to embodiments of the present disclosure, an apparatus and system may be utilized that does not require the use of personnel intensive equipment such as slings, winches, air tuggers and the like. The apparatus disclosed herein is capable of real-time pipe centralization and self-adjustment. Use of the apparatus in running the tubing hanger (and consequently, the production tubing 130) mitigates the risk of inaccurate tubing hanger setting and potential damage to the tubing hanger seals and the tubing hanger itself. Additionally, use of the apparatus disclosed herein further mitigates potential harm to rigsite personnel that comes with conventional tubing hanger setting.

Figure 2B:
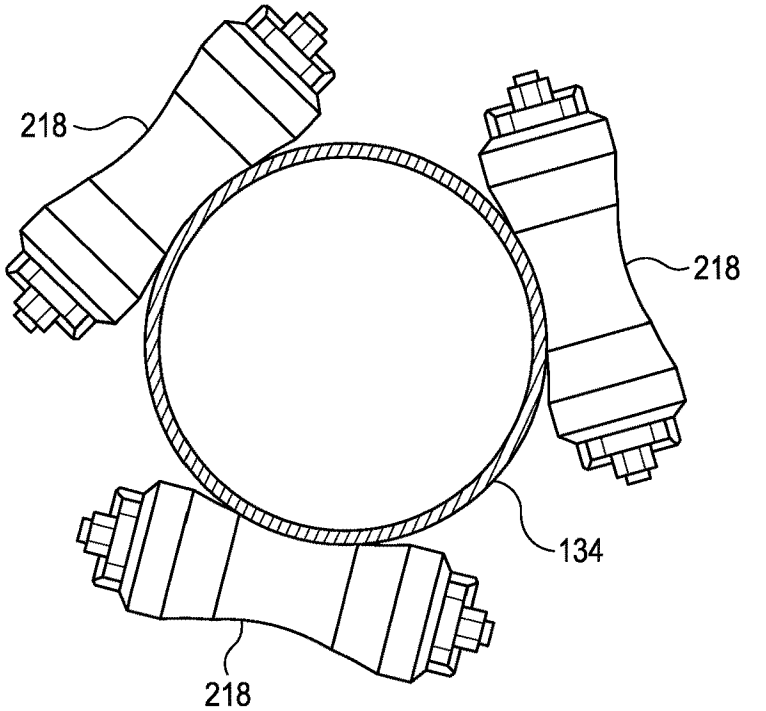
FIG. 2B is a top side view of an example tool deployment apparatus, according to one or more embodiments of the present disclosure.
Figure 2A:
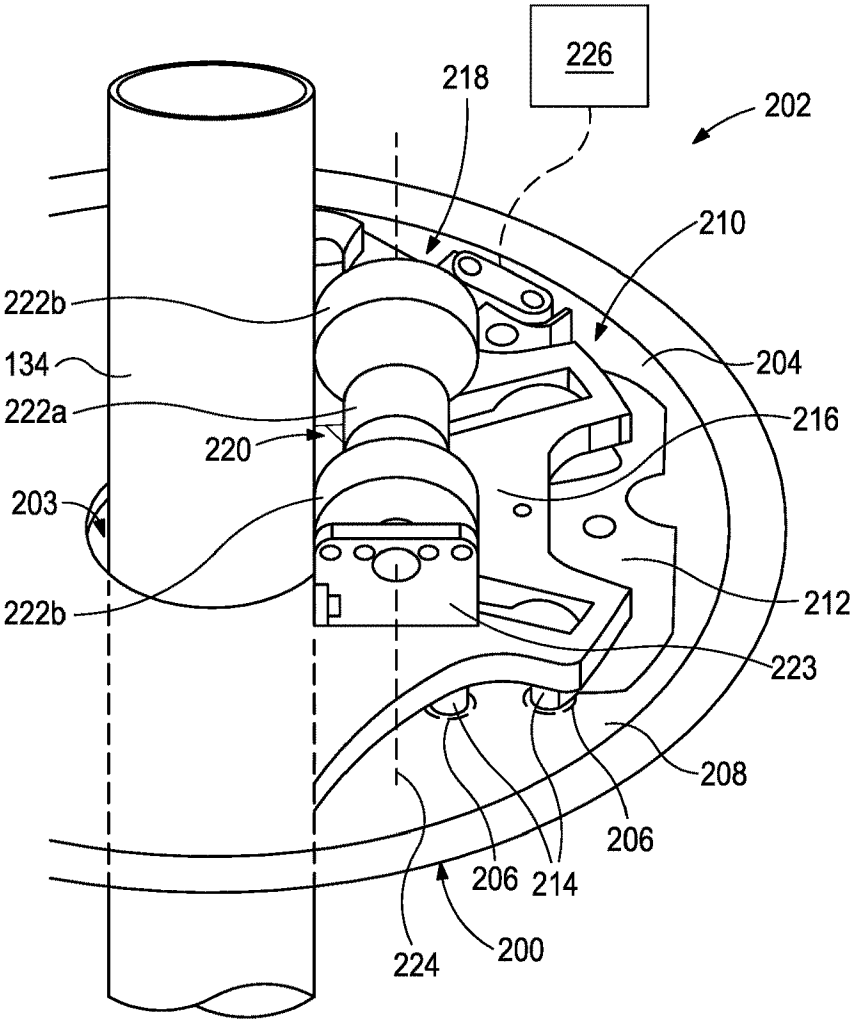
FIG. 2A is a partial, side-view schematic of an example tool deployment apparatus, according to one or more embodiments of the present disclosure.

Referring to FIG. 2A, with continued reference to FIG. 1, depicted is a partial side-view schematic depicting the running of the landing joint string 134 through a rotary table 200 forming part of the rig floor 202 of the platform 102, according to one or more embodiments of the present disclosure. As illustrated, the rotary table 200 includes a master bushing 204, which conventionally comprises two heavy weight inserts secured within and configured to be level with the rotary table 200 when set. When properly positioned in the rotary table 200, the master bushing 204 may define a central opening 203 sized to allow the passage of tubulars, downhole tools or the like. Due to its configuration, the master bushing 204 is operable to receive and secure within the central opening 203 drill pipe slips, or similar, which may be essential to "making up" tubular connections.

The master bushing 204 may also be operable as a surface upon which other apparatuses may be set atop (e.g., kelly bushing, spider or similar). In order to support such apparatuses, the master bushing 204 includes one or more apertures 206 accessible from an upper or top side 208 of the master bushing 204. The apertures 206 may be defined in the master bushing 204 and extend from the top side 208 a distance into the body of the master bushing 204 to receive or accept a matable member. In at least one embodiment, the aperture(s) 206 may be generally cylindrical (e.g., circular, polygonal, etc.) in shape and configured to receive a corresponding cylindrical pin. Accordingly, the configuration of the aperture(s) 206 may comprise any shape operable to receive a matable pin or member of compatible shape and size, without exceeding the scope of this disclosure.

In the example disclosed herein, a tubing hanger (not shown) may be operably coupled to the lower end of the landing joint string 134, and the production tubing 130 (FIG. 1) may extend from the tubing hanger. FIG. 2A depicts the landing joint string 134 extending through the rotary table 200 and toward the wellhead 112 (FIG. 1) so that the tubing hanger may be set within the tubing head housing 128 (FIG. 1). As the landing joint string 134 is lowered, a tubular deployment tool 210 is used to center the landing joint string 134 within the rotary table 200. In at least one embodiment, as shown, the tubular deployment tool 210 may be configured to be positioned atop the master bushing 204.

The tubular deployment tool 210 includes a base 212 providing opposing upper and lower sides. The base 212 comprises a generally flat surface that, when positioned atop the master bushing 204, is parallel or substantially parallel to the top side 208 of the master bushing 204. The tubular deployment tool 210 further includes a plurality of pins 214 extending from the lower side of the base 212 and configured to be received within the apertures 206 of the master bushing 204. In at least one embodiment, receiving the pins 214 within the apertures 206 positions the base 212 so that the lower side is flush or in direct contact with the top side 208 of the master bushing 204. In other embodiments, receiving the pins 214 within the apertures 206 positions the base 212 so that the lower side is positioned a short distance above and parallel (or substantially parallel) to the top side 208. In either embodiment, inserting the pins 214 within the apertures 206 secures the tubular deployment tool 210 in place on the rotary table 200.

The tubular deployment tool 210 further includes a guide support 216 positioned above and operatively coupled to the uppermost portion of the base 212. In at least one embodiment, the guide support 216 sits atop and is parallel to the upper side of the base 212. The guide support 216 comprises a generally flat surface configured to support one or more guides 218 (one shown) that may be positioned and secured to the guide support 216. The base 212 and the guide support 216 may be arranged to cooperatively define at least a portion of a center opening 220 configured to allow the passage of tubulars, such as the landing joint string 134. As the landing joint string 134 is lowered through the rotary table 200 the guides 218 are engageable against the outer surface (circumference) of the landing joint string 134, and may be moved radially inward to apply a radial load (force) against the landing joint string 134 to center the landing joint string 134 within the rotary table 200. In another embodiment, the base 212 may be eliminated entirely. In such an embodiment, the pins 214 may extend directly from the guide support 216 so they may be received by the apertures 206. In such an embodiment, the guide support 216 may be in direct contact with the top side 208 of the master bushing 204 or in the alternative, positioned a short distance above and parallel (or substantially parallel) to the top side 208. In either position, inserting the pins 214 directly coupled to the guide support 216 into the apertures 206, securing the tubular deployment tool 210 in place upon the rotary table 200.

The guides 218 may exhibit a shape and size that enables contact with the outer circumference of the landing joint string 134. In at least one embodiment, the guides 218 may comprise rollers that exhibit a generally arcuate or curved shape to engage and extend about a portion of the outer circumference of the landing joint string 134. The guides 218 comprising rollers may be configured to rotate about an axis 224 extending through the body of the guides 218.

In the illustrated embodiment, the guides 218 include three sections, shown as an inner section 222*a* and two opposing outer sections 222*b* on either side of the inner section 222*a*. The opposing outer sections 222*b* may be rotatably coupled to the guide support 216 by some mechanism, such as opposing brackets 223 coupled to or extending from the guide support 216. The axis 224 may be generally perpendicular to the landing joint string 134 or to any tubular extending through the center opening 220. The combination of the inner and outer sections 222*a,b* forms a generally arcuate or curved shape configured to receive and engage the outer circumference of the landing joint string 134. In the present embodiment, the diameter of the inner section 222*a* is less than the diameter of the outer sections 222*b*. In other embodiments, the diameter of the inner section 222*a* may be the same, or substantially the same, diameter of the outer sections 222*b*.

The inner and outer sections 222*a,b*, or the entire guides 218, may be solid or may alternatively define a hollow interior. The guides 218 may be made of a hardened rubber or other rigid or semi-rigid materials that can engage the outer circumference of the landing joint string 134 without damaging the material of the landing joint string 134.

In one or more embodiments, each guide 218 includes its own discrete actuation system 226, allowing each guide 218 to operate independently of the other guides 218. In other embodiments, however, the actuation system 226 may be configured to actuate each guide 218. Upon engaging the actuation system 226, the guide 218 will be driven radially inward and otherwise toward the outer circumference of the landing joint string 134. In at least one embodiment, the actuation system 226 may be hydraulically actuated and include a hydraulic actuation system. In such embodiments, hydraulic fluid (power) may be supplied by a unit independent of the platform 102, or could alternatively be supplied directly from the platform 102. In other embodiments, however, the actuation system 226 may be powered via other means including, but not limited to, pneumatic actuation, electrical actuation, mechanical actuation, electromechanical actuation, or by any known method of actuation.

In example operation of the tubular deployment tool 210, as the landing joint string 134 is lowered through the rotary table 200, the guides 218 may be actuated to move radially inward until contact is made against the outer circumference of the landing joint string 134. In some embodiments, each of the guides 218 may be actuatable radially inward to a predetermined distance. In such embodiments, the guides 218 may be operable to cooperatively center the landing joint string 134 in the rotary table 200. In other embodiments, however, or in addition thereto, the tubular deployment tool 210 may include one or more proximity sensors (not shown) configured to sense the orientation and location of the landing joint string 134 relative to the real-time position of the guides 218. In such embodiments, the sensors may be programmed to send a signal to the actuation system 226 that causes selective actuation of one or more of the guides 218 to properly center the landing joint string 134 within the rotary table 200.

Once contact with the outer surface of the landing joint string 134 is made, the actuation system 226 may be operated to cause the guides 218 to exert more or less force as necessary to center the landing joint string 134 relative to the wellhead 112, or more particularly, the tubing head housing 128. Once the guides 218 engage the outer circumference of the landing joint string 134, further downward movement (translation) of the landing joint string 134 may cause the guides 218 to roll about their respective axes 224.

FIG. 2B is a top view of the landing joint string 134 and the tubular deployment tool 210. In the depicted example, the tubular deployment tool 210 includes three guides 218 positioned circumferentially and equidistantly spaced from each other. In other embodiments, more than three guides 218 may be included in the tubular deployment tool 210. In any embodiment, at least two guides 218 may be included in the tubular deployment tool 210 to implement positional adjustments to the landing joint string 134.

Figure 3:
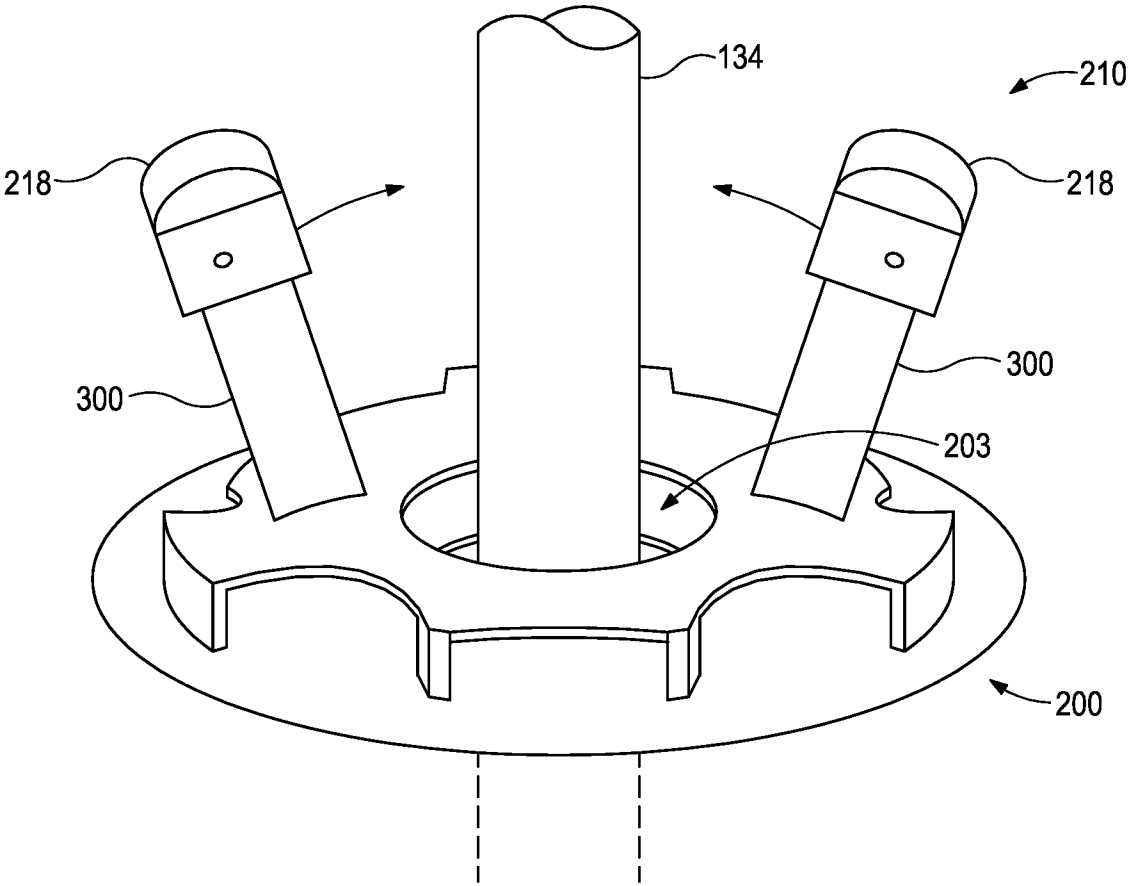
FIG. 3 is a schematic side-view of an example tubular deployment tool, according to one or more embodiments of the present disclosure.

FIG. 3 is a schematic side view of another example of the tubular deployment tool 210, according to one or more embodiments. In the illustrated embodiment, one or more of the guides 218 may be operatively (rotatably) coupled to actuatable arms 300 extending from the guide support 216. The arms 300 may be operatively and rotatably coupled to the guide support 216 so that the arms 300 are able to pivot towards and away from the central opening 203 provided in the rotary table 200, and thus towards and away from the landing joint string 134. In some embodiments, the arms 300 may be hydraulically actuatable to drive the guides 218 radially inward and toward engagement with the landing joint string 134, such as through operation of the actuation system 226 (FIG. 2). In example operation, as the landing joint string 134 is lowered through the rotary table 200 and below the rig floor 202 (FIG. 2), the arms 300 may be selectively actuated (either individually or in concert) to move radially forward (inward) so that the guides 218 may make contact with the landing joint string 134 and center the landing joint string 134 within the central opening 203. In one or more embodiments, the arms 300 may be limited in the distance with which they may move radially forward (inward).

Figure 4:
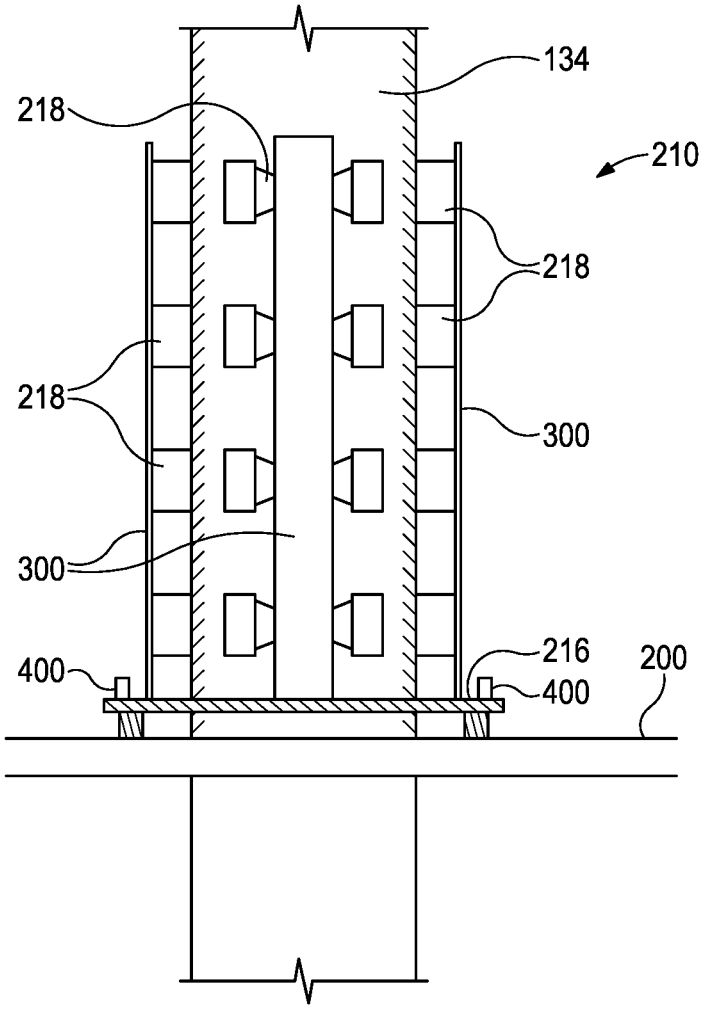
FIG. 4 is a side view of another example of the tubular deployment tool, according to one or more additional embodiments of the present disclosure.

FIG. 4 is a side view of another example of the tubular deployment tool 210, according to one or more additional embodiments. In the illustrated embodiment, the tubular deployment tool 210 may comprise a plurality of arms 300 operatively and rotatably coupled to the guide support 216 so that the arms 300 are able to pivot towards and away from the central opening 203 (FIGS. 2A and 3) provided in the rotary table 200. The arms 300 may be arranged circumferentially about the central opening 203 and may be equidistantly or non-equidistantly spaced from one another.

In some embodiments, as illustrated, one or more of the arms 300 may include two or more guides 218 rotatably coupled thereto. In the illustrated embodiment, each arm 300 includes four guides 218 vertically spaced from each other along the length of the corresponding arm 300. Each arm 300 may be individually or collectively actuated to allow each arm 300 to apply the necessary force to centralize the landing joint string 134.

In some embodiments, as the landing joint string 134 is lowered through the rotary table 200, the arms 300 may be configured to automatically actuate. In such embodiments, the tubular deployment tool 210 may further include one or more proximity sensors 400 configured to sense the presence of a tubular (e.g., the landing joint string 134) and send a signal that causes actuation of the tubular deployment tool 210. Moreover, in such embodiments, the sensors 400 may recognize any misalignment of the landing joint string 134 within the rotary table 200. If misalignment is recognized, the actuation system 226 (FIG. 2) may be activated to center the landing joint string 134 by either actuating the arms 300 in concert or individually and thereby exert more (or less) pressure at desired angular orientations about the landing joint string 134 to correct its alignment within the rotary table 200. In other embodiments, the tubular deployment tool 210 may be selectively actuated by the well operator as needed.

Aligning the landing joint string 134 as it is lowered below the rotary table 200 helps to ensure that the tubing hanger operatively coupled below the tubing hanger running tool and the landing joint string 134 is centered as the tubing hanger is lowered within the tubing hanger spool 128.

The terminology used herein is for the purpose of describing particular embodiments only and is not intended to be limiting of the invention. As used herein, for example, the singular forms "a." "an," and "the" are intended to include the plural forms as well, unless the context clearly indicates otherwise. It will be further understood that the terms "contains", "containing", "includes", "including." "comprises", and/or "comprising." and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A well system, comprising:
- a platform providing a deck;
- a rotary table mounted to the deck and defining a central opening through which tubulars are extendable from the platform and into a wellbore;
- a tubular deployment tool mounted to the rotary table and operable to center the tubulars within the central opening, the tubular deployment tool comprising:
  - a guide support mounted to the rotary table;
  - one or more actuatable arms pivotably coupled to the guide support; and
  - one or more guides rotatably mounted to each actuatable arm to apply a radial load against the tubulars extended through the central opening; and
- an actuation system to pivot the one or more actuatable arms toward and away from the tubulars.

2. The well system of claim 1, wherein the actuation system is to pivot the one or more actuatable arms by at least one of hydraulic actuation, pneumatic actuation, electrical actuation, electromechanical actuation, or any combination thereof.

3. The well system of claim 1, further comprising a wellhead arranged at an opening to the wellbore, wherein centering the tubulars within the central opening correspondingly centers the tubulars within the wellhead.

4. The well system of claim 1, wherein the actuation system is operable to drive the one or more guides into contact with the tubulars extended through the central opening.

5. The well system of claim 4, wherein the actuation system comprises a plurality of actuation systems, and wherein each guide is independently operated by a corresponding one of the plurality of actuation systems.

6. The well system of claim 1, wherein the one or more guides are rotatably coupled to the guide support by opposing brackets extending from the guide support.

7. The well system of claim 1, wherein the one or more guides comprise two or more guides rotatably mounted to each actuatable arm and vertically offset from each other.

8. The well system of claim 1, further comprising one or more proximity sensors operable to sense a presence of the tubulars and send a signal that causes actuation of the actuation system.

9. A well system, comprising:
- a platform providing a deck;
- a rotary table mounted to the deck and defining a central opening through which tubulars are extendable from the platform and into a wellbore;
- a tubular deployment tool mounted to the rotary table and operable to center the tubulars within the central opening, the tubular deployment tool comprising:
  - a guide support mounted to the rotary table;
  - one or more actuatable arms pivotably coupled to the guide support; and
  - one or more guides rotatably mounted to each actuatable arm to apply a radial load against the tubulars extended through the central opening; and
- one or more proximity sensors operable to sense a presence of the tubulars and send a signal that causes actuation of the tubular deployment tool,
- wherein the one or more proximity sensors causes selective actuation of one or more of the guides individually.

10. A tubular deployment tool, comprising:
- a guide support mountable to a rotary table forming part of a deck of an oil and gas platform;
- one or more actuatable arms pivotably coupled to the guide support;
- one more guides rotatably mounted to each actuatable arm and operable to apply a radial load against and center tubulars extended through the rotary table; and
- an actuation system to pivot the one or more actuatable arms in a first rotational direction toward the tubulars and a second rotational direction away from the tubulars.

11. The tubular deployment tool of claim 10, wherein the one or more guides comprise rollers exhibiting an arcuate or curved shape to engage and extend about a portion of an outer circumference of the tubulars.

12. The tubular deployment tool of claim 10, further comprising a plurality of pins extending from the guide support to be received within a plurality of apertures defined within a master bushing of the rotary table.

13. The tubular deployment tool of claim 10, wherein the actuation system is operable to drive the one or more guides into contact with the tubulars extended through the rotary table.

14. The tubular deployment tool of claim 10, further comprising one or more proximity sensors operable to sense the tubulars and send a signal that causes actuation of the actuation system.

15. The tubular deployment tool of claim 10, wherein the one or more guides are rotatably coupled to the guide support by opposing brackets extending from the guide support.

16. The well system of claim 1, wherein the one or more guides comprise rollers exhibiting an arcuate or curved shape to engage and extend about a portion of an outer circumference of the tubulars.

17. The well system of claim 9, further comprising an actuation system to pivot the one or more actuatable arms toward and away from the tubulars.

18. The well system of claim 9, wherein the one or more guides comprise rollers exhibiting an arcuate or curved shape to engage and extend about a portion of an outer circumference of the tubulars.

19. The tubular deployment tool of claim 10, wherein the actuation system comprises a plurality of actuation systems, and wherein each guide is independently operated by a corresponding one of the plurality of actuation systems.

20. The tubular deployment tool of claim 14, wherein the one or more proximity sensors causes selective actuation of one or more of the guides individually.

* * * * *